US010032423B2

(12) United States Patent
Ahn et al.

(10) Patent No.: US 10,032,423 B2
(45) Date of Patent: Jul. 24, 2018

(54) DISPLAY DEVICE OF IMPROVED DISPLAY QUALITY AND REDUCED POWER CONSUMPTION

(71) Applicant: SAMSUNG DISPLAY CO., LTD., Yongin-si, Gyeonggi-do (KR)

(72) Inventors: Ik Hyun Ahn, Yongin-si (KR); Yoon Gu Kim, Yongin-si (KR); Bong Im Park, Yongin-si (KR); Hyun Sik Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 204 days.

(21) Appl. No.: 15/043,262

(22) Filed: Feb. 12, 2016

(65) Prior Publication Data

US 2016/0372025 A1 Dec. 22, 2016

(30) Foreign Application Priority Data

Jun. 17, 2015 (KR) ..... 10-2015-0086103

(51) Int. Cl.
*G09G 3/36* (2006.01)

(52) U.S. Cl.
CPC ..... *G09G 3/3655* (2013.01); *G09G 3/3614* (2013.01); *G09G 2320/0219* (2013.01); *G09G 2320/0257* (2013.01); *G09G 2330/021* (2013.01); *G09G 2340/0407* (2013.01)

(58) Field of Classification Search
CPC ..... G09G 2310/04; G09G 2330/021; G09G 2320/0219; G09G 2340/0407; G09G 2320/0257; G09G 2310/0221; G09G 3/3275; G09G 3/3677; G09G 3/3688; G09G 3/3655; G09G 3/3696; G09G 3/3644; G09G 3/3666
See application file for complete search history.

(56) References Cited

U.S. PATENT DOCUMENTS 5,896,117 A * 4/1999 Moon ..... G09G 3/3677 345/211
2006/0061520 A1* 3/2006 Speirs ..... G09G 3/3681 345/55
2007/0024564 A1* 2/2007 Shimizu ..... G09G 3/3655 345/98

FOREIGN PATENT DOCUMENTS

JP 2006-154224 A 6/2006

* cited by examiner

*Primary Examiner* — Larry Lee
(74) *Attorney, Agent, or Firm* — Lewis Roca Rothgerber Christie LLP

(57) ABSTRACT

The disclosed display device of improved display quality and reduced power consumption includes a display unit including pixels coupled to gate lines and data lines, a gate driving unit for outputting a gate signal to the gate lines, a data driving unit for outputting a data signal to the data lines, a voltage supply unit for supplying to the gate driving unit a gate-on voltage to generate the gate signal a gate-off voltage, and a kickback compensation voltage having a voltage level varied at a section of time of the gate-on voltage, and a display mode control unit for controlling the voltage supply unit to supply the kickback compensation voltage during a first display mode for displaying an image on an entire area of the display unit, and to block supply of the kickback compensation voltage during a second display mode for displaying an image on only a partial area.

14 Claims, 3 Drawing Sheets

DISPLAY DEVICE OF IMPROVED DISPLAY QUALITY AND REDUCED POWER CONSUMPTION

CROSS-REFERENCE TO RELATED APPLICATION

This application claims priority to, and the benefit of, Korean Patent Application No. 10-2015-0086103, filed on Jun. 17, 2015, in the Korean Intellectual Property Office, the entire content of which is incorporated herein by reference in its entirety.

BACKGROUND

1. Field

Aspects of embodiments of the present invention relate to a display device, and more particularly, to a display device to improve display quality and reduce power consumption.

2. Description of the Related Art

A display device, such as a liquid crystal display device, includes a display unit for displaying an image, a data driving unit for driving the display unit, and a gate driving unit. The display unit includes a plurality of pixels coupled with gate lines and data lines. Each of the pixels includes a switching element, a liquid crystal capacitor, and a storage capacitor.

A gate signal supplied to the gate line may transition from a gate-off voltage to a gate-on voltage to thereby turn on the switching element by the gate-on voltage, and to recharge the liquid crystal capacitor and the storage capacitor with a data voltage supplied to the data line. Then, the gate signal may transition from the gate-on voltage to the gate-off voltage, to thereby turn off the switching element by the gate-off voltage. The data voltage charged in the liquid crystal capacitor and the storage capacitor may be maintained for a period of time. However, due to a parasitic capacitance of the switching element, a kickback voltage may be generated, which may degrade the quality of the image displayed on the display device.

To lower the kickback voltage, a technology of inserting a kickback compensation section that drops the gate signal from the gate-on voltage to a kickback compensation voltage has been developed. However, generating the kickback compensation voltage may increase the power consumption of the display device. In particular, a mobile device or a display device having a partial display mode for displaying only partial area of the display unit may benefit from a reduction in power consumption.

SUMMARY

The display device according to an embodiment of the present invention includes a display unit including a plurality of pixels coupled to gate lines and data lines, a gate driving unit for outputting a gate signal to the gate lines, a data driving unit for outputting a data signal to the data lines, a voltage supply unit for supplying, to the gate driving unit a gate-on voltage to generate the gate signal, a gate-off voltage, and a kickback compensation voltage having a voltage level varied at a section of the gate-on voltage, and a display mode control unit for controlling the voltage supply unit to supply the kickback compensation voltage during a first display mode for displaying an image on an entire area of the display unit, and to block supply of the kickback compensation voltage during a second display mode for displaying an image on only a partial area of the display unit.

The display mode control unit may be configured to generate a kickback compensation control signal for controlling supply of the kickback compensation voltage.

A voltage level of the kickback compensation voltage may correspond to a kickback voltage generated during the first display mode.

The gate signal may have a falling edge between the gate-on voltage and the gate-off voltage, the falling edge including a slice section due to the kickback compensation voltage.

The display device may further include a memory for storing information of the kickback compensation voltage.

The voltage supply unit may be configured to supply a common voltage to the display unit, and the display mode control unit may be configured to generate a common voltage control signal for controlling the voltage supply unit to supply a first common voltage as the common voltage during the first display mode, and to supply a second common voltage, which has a lower voltage level than the first common voltage, as the common voltage during the second display mode.

A voltage level of the second common voltage may correspond to a kickback voltage generated during the second display mode.

A voltage level of the second common voltage may be between a positive data voltage and a negative data voltage.

The display mode control unit may be configured to generate a gate-on voltage control signal for controlling the voltage supply unit to supply a first gate-on voltage as the gate-on voltage during the first display mode, and to supply a second gate-on voltage, which has a lower voltage level than the first gate-on voltage, as the gate-on voltage during the second display mode.

The second gate-on voltage may correspond to a kickback voltage generated during the second display mode.

The second gate-on voltage may be between the first gate-on voltage and the gate-off voltage.

The display mode control unit may be configured to generate a gate timing control signal for controlling the gate driving unit to supply the gate signal at a first output time during the first display mode, and to supply the gate signal at a second output time, which is before the first output time, during the second display mode.

The second output time may correspond to a gate delay margin generated during the second display mode.

The data driving unit may be configured to be operated in an inverse operation manner by inverting a voltage polarity of the data signal.

BRIEF DESCRIPTION OF THE DRAWINGS

Example embodiments will now be described more fully hereinafter with reference to the accompanying drawings, wherein.

DETAILED DESCRIPTION

Figure 1:
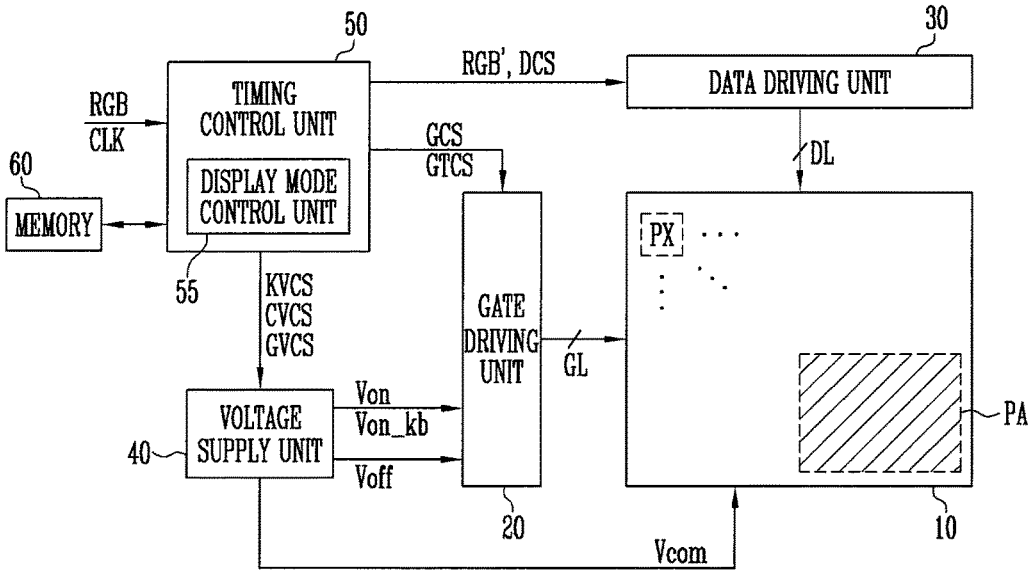
FIG. 1 is a schematic diagram illustrating a display device according to an embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
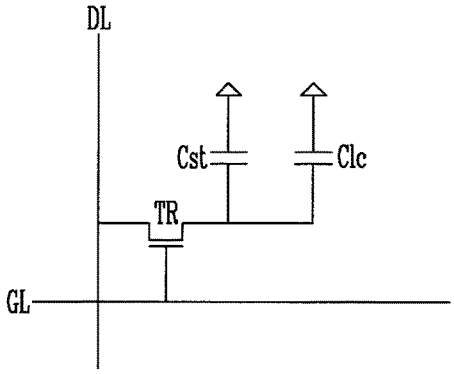
FIG. 2 is a diagram illustrating an equivalent circuit of an embodiment of one of pixels shown in FIG. 1.

FIG. 1 is a schematic diagram illustrating a display device according to an embodiment of the present invention, and FIG. 2 is a diagram illustrating an equivalent circuit of an embodiment of one of pixels shown in FIG. 1.

Referring to FIG. 1, the display device may include a display unit 10, a gate driving unit 20, a data driving unit 30, a voltage supply unit 40, a timing control unit 50, and a memory 60.

In the present embodiment, the display device is a liquid crystal display LCD, and the display unit 10 may be a liquid display panel. The display unit 10 may be operated in a plurality of display modes. The display modes may include a first display mode for displaying an entire area of the display unit 10, a second display mode for displaying a partial area of the display unit 10 while a remaining area, which does not include the partial area, has no images displayed therein (i.e., an image is displayed on only a partial area of the display unit). The first and second display modes may be operated selectively by a user, and a size of the partial area displayed during the second display mode may vary, and be determined by the user.

The display unit 10 may include a plurality of pixels PX arranged in matrix form and coupled to gate lines GL and to data lines DL. The pixels PX receive a gate signal through the gate lines GL, and receive a data signal through the data lines DL. The pixels PX are configured to emit light with a brightness corresponding to the data signal supplied from data lines Dm when the gate signal is supplied from the gate lines GL.

Referring to FIG. 2, each of the pixels may include a switching element TR, a liquid crystal capacitor Clc, and a storage capacitor Cst. A gate electrode of the switching element TR may be coupled to a gate line GL, and a first electrode of the switching element TR may be coupled to a data line DL. The liquid crystal capacitor Clc and the storage capacitor Cst may be coupled at ends thereof to a drain electrode of the switching element TR, whereas other ends of the capacitors Clc and Cst are coupled to a common voltage line for supplying a common voltage Vcom. Due to a parasitic capacitance of the switching element TR provided in pixels PX, a kickback voltage may be generated, and data signals supplied to the pixels PX are changed, which may thereby degrade the quality of an image displayed on the display device.

A gate driving unit 20 may be coupled to a plurality of gate lines GL, may generate gate signals in response to gate control signals GCS of the timing control unit 50, and may output the generated gate signals to the gate lines GL. To be more specific, a gate-on voltage Von and a gate-off voltage Voff may be supplied to the gate driving unit 20, and the gate signals formed of the gate-on voltage Von and the gate-off voltage Voff may be output to the gate lines GL.

Figure 3:
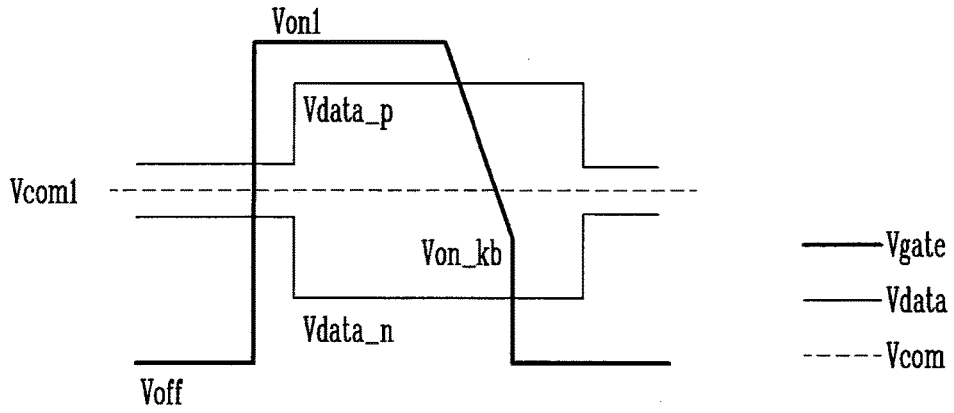
FIG. 3 is a diagram illustrating a waveform of a gate signal during a first display mode according to an embodiment of the present invention.

Further, the gate driving unit 20 may generate a gate signal using a kickback compensation voltage Von_kb supplied from the voltage supply unit 40. The kickback compensation voltage Von_kb may have a lower level of voltage compared to the gate-on voltage Von, and may have a higher voltage level than the gate-off voltage Voff. The gate driving unit 20 may generate the gate signal by inputting the kickback compensation voltage Von_kb to generate a voltage drop at a section (e.g., a section of time) where the gate-on voltage Von is transitioned to the gate-off voltage Voff. In other words, the gate driving unit 20 may gradually drop the voltage of the gate signal from the gate-on voltage Von to the kickback compensation voltage Von_kb, and from the kickback compensation voltage Von_kb to the gate-off voltage Voff, in that respective order. An output waveform of the gate signal may have a falling edge between the gate-on voltage Von and the gate-off voltage Voff, wherein the falling edge includes a slice section (e.g., an angled section, or an angled falling edge of the gate signal, as seen in FIG. 3) due to the kickback compensation voltage Von_kb.

The data driving unit 30 may be coupled to the plurality of data lines DL, may generate a data signal based on data control signals DCS and video data RGB' of the timing control unit 50, and may output the generated data signals to the data lines DL. Each time a gate signal is supplied, the data signal supplied to the data lines DL may be supplied to selected pixels PX in accordance with gate signals. Then, pixels PX may charge voltages corresponding to the digital signals. In an embodiment, the data driving unit 30 may be operated in an inverse manner by inverting the voltage polarity of the data signals.

A voltage supply unit 40 may generate and supply the gate-on voltage Von and the gate-off voltage Voff to the gate driving unit 20. The voltage supply unit 40 may generate the kickback compensation voltage Von_kb having a voltage level varied at a partial section (e.g., a partial period of time) of the gate-on voltage Von to supply to the gate driving unit 20. The voltage supply unit 40 may generate the kickback compensation voltage Von_kb in response to a kickback compensation control signal KVCS of the timing control unit 50. The kickback compensation voltage Von_kb may be generated separately from the gate-on voltage Von, may be output along with the gate-on voltage Von, or may be output in replacement of the gate-on voltage Von at a given section of time. For example, the kickback compensation voltage Von_kb may be set to have a lower voltage level at the falling edge of the gate-on voltage Von. The voltage level of the kickback compensation voltage Von_kb may be set in response to a kickback voltage generated during a first display mode for displaying the entire area of the display unit 10. Also, the voltage supply unit 40 may generate and supply the common voltage Vcom, which is used as a reference voltage of the data signals, to the display unit 10.

The timing control unit 50 may receive a clock signal CLK of a video data RGB to display the data. The timing control unit 50 may generate the video data RGB', which is corrected to be appropriate for display on the display unit 10, by processing the video of the input video data RGB. The timing control unit 50 may also generate and output driving control signals GCS and DCS for respectively controlling operations of the gate driving unit 20 and the data driving unit 30 based on the clock signal CLK. To be more specific, the timing control unit 50 may generate and supply the gate control signal GCS to the gate driving unit 20, and may generate and supply the data control signal DCS to the data driving unit 30.

According to an embodiment, the timing control unit 50 may include a display mode control unit 55 for controlling the gate driving unit 20, the data driving unit 30, and the voltage supply unit 40 to operate the display unit in a selected mode. The display mode may be a first display mode for displaying an entire area of the display unit 10, and may be a second display mode for displaying an image at a partial area of the display unit 10 while a remaining area not including the partial area is non-displayed.

The display mode control unit 55 may control the voltage supply unit 40 to supply the kickback compensation voltage Von_kb to the gate driving unit 20 during the first display mode. The display mode control unit 55 may control the voltage supply unit 40 to block the supply of the kickback compensation voltage Von_kb during the second display mode. To that end, the display mode control unit 55 may generate the kickback compensation control signal KVCS for turning the supply of the kickback compensation voltage Von_kb on or off. In other words, the display mode control unit 55 may compensate the kickback voltage by generating the gate signal using the kickback compensation voltage Von_kb during the first display mode, and may reduce power consumption by blocking the supply of the kickback compensation voltage Von_kb during the second display mode.

The display mode control unit 55 may block the supply of the kickback compensation voltage Von_kb in the second display mode, and may vary the voltage level of the common voltage Vcom or the level of the gate-on voltage Von to improve the quality of the image being displayed due to the kickback voltage. The display mode control unit 55 may vary an output time of the gate signal to compensate for a delay margin of the gate signal. To that end, the display mode control unit 55 may generate a common voltage control signal CVCS for controlling the voltage supply unit 40 to vary the voltage level of the common voltage Vcom, and may generate a gate-on voltage control signal GVCS for controlling the voltage supply unit 40 to vary the voltage level of the gate-on voltage Von. In addition, the display mode control unit 55 may generate a gate timing control signal GTCS for controlling the gate driving unit 20 to vary the output time of the gate signal.

According to an embodiment, the display mode control unit 55 may be integral and included in the timing control unit 50, although the present invention is not limited thereto. In another embodiment, the display mode control unit 55 and the timing control unit 50 may be separate compositions.

A memory 60 may pre-store data related to operations of the plurality of display modes. For example, a first gate-on voltage Von1 (see FIGS. 3 to 5) corresponding to the first display mode, the kickback compensation voltage Von_kb, a first common voltage Vcom1 (see FIGS. 3 to 5), and a voltage level data may be pre-stored, and the memory 60 may also pre-store a second gate-on voltage Von2 (see FIG. 5) and a second common voltage Vcom2 (see FIG. 4) corresponding to the second display mode.

FIG. 3 is a diagram illustrating a waveform of a gate signal when operating in a first display mode according to an embodiment of the present invention.

As described above, due to the kickback voltage generated by the parasitic capacitance of the switching element TR in the pixels PX, flicker and/or afterimage may be generated in the image being displayed, because the data signal supplied to the pixels PX are changed.

Referring to FIG. 3, the display device of the present embodiment may reduce the kickback voltage by dropping the gate signal Vgate from the gate-on voltage Von1 to the voltage level of the kickback compensation voltage Von_kb during the first display mode for displaying in the entire area of the display unit 10, and may thereby improve display quality otherwise adversely affected by the flicker and the afterimage that may be generated by the kickback voltage.

To be more specific, the display mode control unit 55 may generate the kickback compensation control signal KVCS for turning on the supply of the kickback compensation voltage Von_kb in the first display mode, and may output the kickback compensation control signal KVCS to the voltage supply unit 40. The voltage supply unit 40 may generate the kickback compensation voltage Von_kb in response to the kickback compensation control signal KVCS, and may output the kickback compensation voltage Von_kb to the gate driving unit 20. Then, the gate driving unit 20 may generate a gate signal Vgate by inserting the kickback compensation voltage Von_kb to generate a gradual voltage drop transitioning the gate signal Vgate from the gate-on voltage Von to the gate-off voltage Voff. The voltage level of the kickback compensation voltage Von_kb and the applied section where the gate signal Vgate is inserted may be stored after being statistically/empirically calculated depending on the model of the display device, or may be generated through an equation or a histogram.

For example, in the first display mode, the display mode control unit 55 may control the voltage supply unit 40 by generating and outputting the kickback compensation control signal KVCS based on the voltage level data of a first gate-on voltage Von1, based on the kickback compensation voltage Von_kb, and based on the first common voltage Vcom1 stored in the memory 60 corresponding to the first display mode. Accordingly, in the first display mode, the gate signal Vgate may maintain the first gate-on voltage Von1 for a section, and may gradually drop to the gate-off voltage Voff after passing the kickback compensation voltage Von_kb. The output waveform of the gate signal Vgate may have a falling edge between the first gate-on voltage Von1 and the gate-off voltage Voff, wherein the falling edge includes a slice section due to the compensation voltage Von_kb (e.g., an angled section of the gate signal Vgate shown in FIG. 3).

On the other hand, a data voltage Vdata may be defined as a voltage of a data signal supplied to the liquid crystal capacitor Clc and to the storage capacitor Cst. According to an embodiment, the data driving unit 30 may be operated in an inverse manner by inverting the voltage polarity of the data signal; the data voltage Vdata may have a positive polarity data voltage having a higher voltage level Vdata_p than the common voltage Vcom1, and may have a negative data voltage having a lower voltage level Vdata_n than the common voltage Vcom1.

Figure 4:
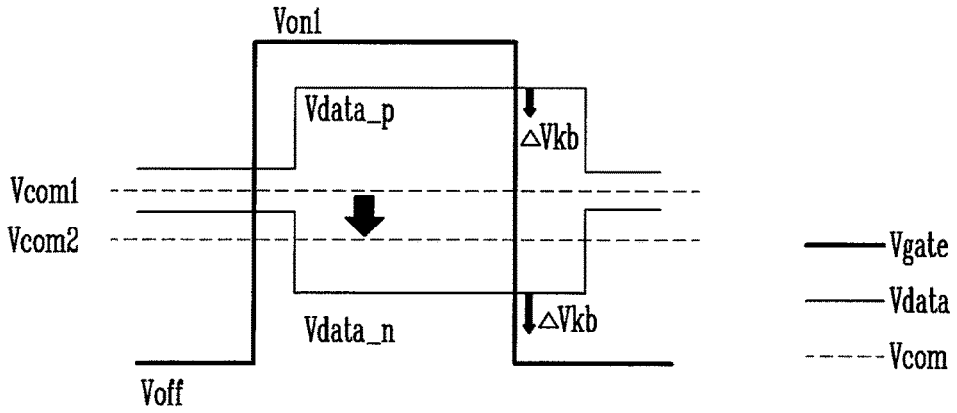
FIG. 4 is a diagram illustrating a waveform of a gate signal during a second display mode according to an embodiment of the present invention.
Figure 5:
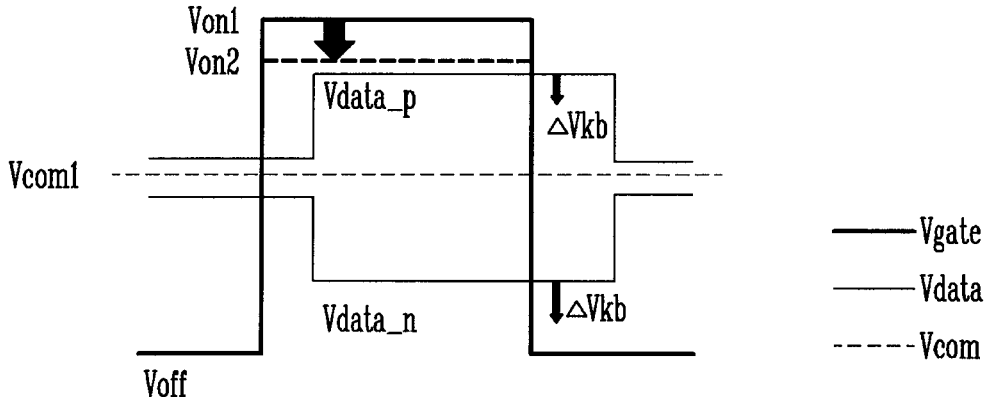
FIG. 5 is a diagram illustrating a waveform of a gate signal during the second display mode according to an embodiment of the present invention.
Figure 6:
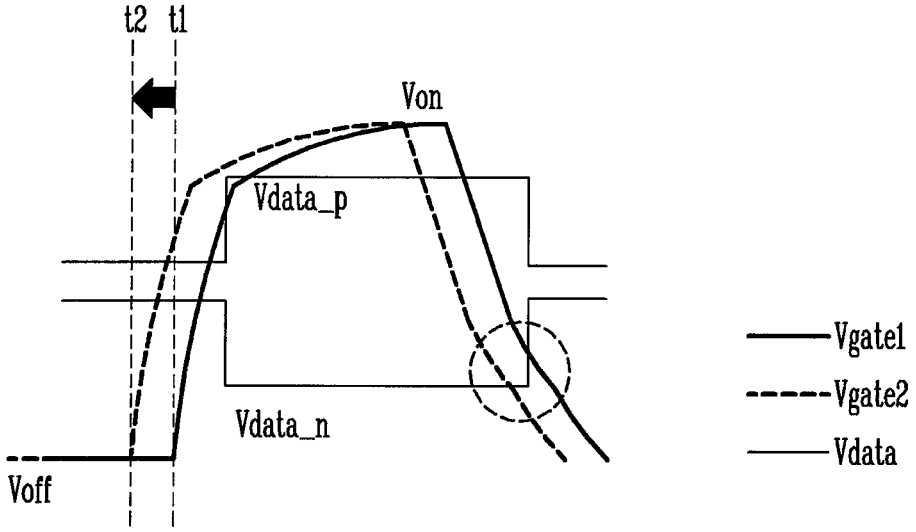
FIG. 6 is a diagram illustrating a waveform of a gate signal during the second display mode according to an embodiment of the present invention.

FIGS. 4, 5, and 6 are diagrams illustrating output waveforms of a gate signal when operated in a second display mode.

As described above, the display mode control unit 55 may block the supply of the kickback compensation voltage Von_kb in the second display mode, which is a partial display mode, but may also vary the voltage level of the gate-on voltage Von or may vary the voltage level of the common voltage Vcom to solve the display degradation due to the kickback voltage. Also, the display mode control unit 55 may vary the output time of the gate signal Vgate to compensate for a gate delay margin.

Referring to FIG. 4, the display mode control unit 55 may generate and output the common voltage control signal CVCS for controlling the voltage supply unit 40 that supplies a second common voltage Vcom2 that has a lower voltage level than a first common voltage Vcom1 in the display mode, and the voltage supply unit 40 may generate and supply the second common voltage Vcom2 to the display unit 10 in response to the common voltage control signal CVCS. The first common voltage Vcom1 may be a common voltage Vcom supplied in the first display mode, and the second common voltage Vcom2 may be a common voltage Vcom supplied by being reset in response to the kickback voltage ΔVkb generated in the second display mode.

In contrast to the first display mode, the second display mode may block the supply of the kickback compensation voltage Von_kb, thereby increasing the kickback voltage, which may make the first common voltage Vcom1 set in the first display mode no longer an optimal common voltage Vcom. In other words, due to the increased kickback voltage ΔVkb, the first common voltage Vcom1 may not be a middle voltage level between the positive data voltage Vdata_p and the negative data voltage Vdata_n, thus degrading display quality in the second display mode. Accordingly, in the second display mode, a new second common voltage Vcom2 may be supplied in consideration of the increased kickback voltage ΔVkb from the first display mode. The second common voltage Vcom2 may be set to be a middle voltage level between the positive data voltage Vdata_p and the negative data voltage Vdata_n.

For example, in the second display mode, the display mode control unit 55 may generate the common voltage control signal CVCS stored in the memory 60 by referring to a voltage level data of a second common voltage Vcom2 corresponding to the second display mode, and may control the voltage supply unit 40. Accordingly, in the second display mode, the gate signal Vgate output from the gate driving unit 20 may have a waveform swinging between the first gate-on voltage Von1 and the gate-off voltage Voff without a kickback compensation voltage Von_kb inserted during the section, and the voltage level of the common voltage Vcom may be changed from the first common voltage Vcom1 to a second common voltage Vcom2 having a voltage level lower that is lower than the first common voltage Vcom1

Referring to FIG. 5, the display mode control unit 55 may generate and output a gate-on voltage control signal GVCS for controlling the power supply unit 40 and for supplying a second gate-on voltage Von2 having a lower voltage level than the first gate-on voltage Von1 in the second display mode, and the voltage supply unit 40 may generate the second gate-on voltage Von2 in response to the gate-on voltage control signal GVCS to output to the gate driving unit 20. The first gate-on voltage Von1 may be the gate-on voltage Von supplied in the first display mode, and the second gate-on voltage Von2 may be a gate-on voltage Von reset in response to the kickback voltage ΔVkb generated in the second display mode.

To be more specific, when comparing the first display mode and the second display mode, the kickback compensation voltage Von_kb may be blocked in the second display mode, thereby increasing the kickback voltage ΔVkb, and thereby causing the first common voltage Vcom1 to no longer be the optimal common voltage Vcom set for the first display mode. According to an embodiment, the first common voltage Vcom1 may be maintained for the second display mode. However, considering the increased kickback voltage ΔVkb compared to the kickback voltage ΔVkb in the first display mode, a new second gate-on voltage Von2 may be supplied. The second gate-on voltage Von2 may reduce the voltage difference between the gate-on voltage Von and the gate-off voltage Voff, and may thereby reduce the kickback voltage ΔVkb.

For example, in second display mode, the display mode control unit 55 may control the voltage supply unit 40 by generating and outputting the gate-on voltage control signal GVCS based on the voltage level data of the second gate-on voltage Von2 corresponding to the second display mode stored in the memory 60. Accordingly, when operating in the second display mode, a first common voltage Vcom1 may be maintained, and the gate signal Vgate output from the gate driving unit 20 may have a waveform swinging between the gate-on voltage control signal GVCS and the gate-off voltage Voff without inserting the kickback compensation voltage. However, the second gate-on voltage Von2 may be lower than the first gate-on voltage Von1 to reduce the voltage difference with the gate-off voltage Voff.

Referring to FIG. 6, the display mode control unit 55, may generate and output a gate timing control signal GTCS for controlling the gate driving unit 20 to supply the second gate signal Vgate2 shifted to a second output time t2 preceding the first output time t1 during the second display mode, and the gate driving unit 20 may shift the timing of the second gate signal Vgate2 to precede the timing of the first gate signal Vgate1 for a period of time in response to the gate timing control signal GTCS. The first output time t1 may be a first gate signal Vgate1 timing corresponding to when the first gate signal Vgate1 is output during the first display mode, and the second output time t2 may be a second gate signal Vgate2 timing, which is when a second gate signal Vgate2 is reset in response to the gate delay margin generated during the second display mode.

To be more specific, in the second display mode, the supply of the kickback compensation voltage Von_kb may be blocked, which may allow the second gate signal Vgate2 to generate a defect in the quality of the image because the data voltage Vdata fails to be charged due to an increased gate RC delay. According to an embodiment, in the second display mode, the common voltage Vcom and the gate-on voltage Von of the first display mode may be maintained, however the gate signal output time may change (e.g., from t1 to t2). In other words, the timing of the second gate signal Vgate2 may be shifted to precede the timing of the first gate signal Vgate1. Accordingly, the gate delay margin generated during the second display mode may be compensated.

On the other hand, in the above described embodiments, ways to change the voltage level of the common voltage Vcom or the gate-on voltage Von in the second display mode, or ways to vary the output time of the gate signal Vgate, may be applied differently than the methods described above. However, by combining the plurality of the abovementioned embodiments, by applying the one of the embodiments, and/or by applying the embodiments at the same time, the quality of image may improve.

According to an embodiment of the present invention, by blocking the supply of the kickback compensation voltage during the partial display mode, the power consumption for the supply of the kick back compensation voltage may be reduced.

Afterimages due to the kickback voltage may also be improved by properly varying at least one among the common voltage Vcom or the gate-on voltage Von when operating the display device in a partial display mode.

In an embodiment, uneven brightness due to the gate delay margin may also be resolved by adjusting the output time of the gate signal Vgate when operating the display device in the partial display mode.

Example embodiments have been disclosed herein, and although specific terms are employed, they are sued and are to be interpreted in a generic and descriptive sense only and not for purpose of limitation. In some instances, as would be apparent to one of ordinary skill in the art as the filing of the present application, features, characteristics and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising;

a display unit comprising a plurality of pixels coupled to gate lines and data lines;

a gate driving unit for outputting a gate signal to the gate lines;

a data driving unit for outputting a data signal to the data lines;

a voltage supply unit for supplying to the gate driving unit:

a gate-on voltage to generate the gate signal;

a gate-off voltage; and a kickback compensation voltage having a voltage level varied at a section of time of the gate-on voltage; and a display mode control unit for controlling the voltage supply unit to supply the kickback compensation voltage during a first display mode for displaying an image on an entire area of the display unit, and to block supply of the kickback compensation voltage during a second display mode for displaying an image on only a partial area of the display unit.

2. The display device of claim 1, wherein the display mode control unit is configured to generate a kickback compensation control signal for controlling supply of the kickback compensation voltage.

3. The display device of claim 2, wherein a voltage level of the kickback compensation voltage corresponds to a kickback voltage generated during the first display mode.

4. The display device of claim 3, wherein the gate signal has a falling edge between the gate-on voltage and the gate-off voltage, the falling edge comprising a slice section due to the kickback compensation voltage.

5. The display device of claim 1, further comprising a memory for storing information of the kickback compensation voltage.

6. The display device of claim 1, wherein the voltage supply unit is configured to supply a common voltage to the display unit, and wherein the display mode control unit is configured to generate a common voltage control signal for controlling the voltage supply unit to supply a first common voltage as the common voltage during the first display mode, and to supply a second common voltage, which has a lower voltage level than the first common voltage, as the common voltage during the second display mode.

7. The display device of claim 6, wherein a voltage level of the second common voltage corresponds to a kickback voltage generated during the second display mode.

8. The display device of claim 7, wherein a voltage level of the second common voltage is between a positive data voltage and a negative data voltage.

9. The display device of claim 1, wherein the display mode control unit is configured to generate a gate-on voltage control signal for controlling the voltage supply unit to supply a first gate-on voltage as the gate-on voltage during the first display mode, and to supply a second gate-on voltage, which has a lower voltage level than the first gate-on voltage, as the gate-on voltage during the second display mode.

10. The display device of claim 9, wherein the second gate-on voltage corresponds to a kickback voltage generated during the second display mode.

11. The display device of claim 10, wherein the second gate-on voltage is between the first gate-on voltage and the gate-off voltage.

12. The display device of claim 1, wherein the display mode control unit is configured to generate a gate timing control signal for controlling the gate driving unit to supply the gate signal at a first output time during the first display mode, and to supply the gate signal at a second output time, which is before the first output time, during the second display mode.

13. The display device of claim 12, wherein the second output time corresponds to a gate delay margin generated during the second display mode.

14. The display device of claim 1, wherein the data driving unit is configured to be operated in an inverse operation manner by inverting a voltage polarity of the data signal.

* * * * *